US007384578B2

(12) United States Patent
Hoshino et al.

(10) Patent No.: US 7,384,578 B2
(45) Date of Patent: Jun. 10, 2008

(54) MODIFIED ELECTROCONDUCTIVE POLYMER MATERIAL AND METHOD FOR PREPARATION THEREOF

(75) Inventors: Katsuyoshi Hoshino, Chiba (JP); Hiroyuki Watanabe, Chiba (JP)

(73) Assignee: Chisso Corporation, Tokyo (JP)

( * ) Notice: Subject to any disclaimer, the term of this patent is extended or adjusted under 35 U.S.C. 154(b) by 0 days.

(21) Appl. No.: 10/526,147

(22) PCT Filed: Sep. 3, 2003

(86) PCT No.: PCT/JP03/11253

§ 371 (c)(1),
(2), (4) Date: Oct. 21, 2005

(87) PCT Pub. No.: WO2004/022631

PCT Pub. Date: Mar. 18, 2004

(65) Prior Publication Data

US 2006/0124905 A1 Jun. 15, 2006

(30) Foreign Application Priority Data

Sep. 4, 2002 (JP) ..... 2002-259456

(51) Int. Cl.
*H01B 1/12* (2006.01)
*H01B 1/02* (2006.01)
*H01B 1/08* (2006.01)

(52) U.S. Cl. ..... 252/519.33; 252/512; 252/518.1; 252/519.3; 252/520.1; 252/520.2; 252/521.2

(58) Field of Classification Search ..... 252/500, 252/519.33, 512, 518.1, 519.3, 520.1, 520.2, 252/521.2; 427/124, 584, 585
See application file for complete search history.

(56) References Cited

U.S. PATENT DOCUMENTS

| | | | | |
|---|---|---|---|---|
| 4,477,485 | A * | 10/1984 | Muramatsu et al. | 427/525 |
| 5,068,060 | A * | 11/1991 | Jen et al. | 252/500 |
| 5,286,415 | A * | 2/1994 | Buckley et al. | 252/502 |
| 6,440,332 | B1 * | 8/2002 | Geer et al. | 252/512 |
| 6,507,428 | B1 * | 1/2003 | Heuer et al. | 359/273 |
| 6,613,452 | B2 * | 9/2003 | Weir | 428/652 |

(Continued)

FOREIGN PATENT DOCUMENTS

EP 0 468 438 A2 1/1992

(Continued)

OTHER PUBLICATIONS

STN Registry database entry for Baytron P.*

*Primary Examiner*—Mark Kopec
*Assistant Examiner*—Jaison Thomas
(74) *Attorney, Agent, or Firm*—Westerman, Hattori, Daniels & Adrian, LLP.

(57) ABSTRACT

Disclosed is a modified electroconductive polymer material, which comprises a metal filled in a space between the chains of an electroconductive polymer. The metal is oxidized (partially formed as a hydroxide) through a chemical reaction between three substances consisting of the metal, a cation radical/dication, and absorbed water. The metal has a work function less than that of the electroconductive polymer. The contact between the metal and the electroconductive polymer is kept in the state of coexistence between three substances consisting of the metal, the cation radical/dication and the absorbed water. This allows an electroconductive polymer material to have enhanced durability against oxidation/reduction, and controlled conductivity.

7 Claims, 4 Drawing Sheets

U.S. PATENT DOCUMENTS 6,632,380 B1 * 10/2003 Wessling ..... 252/500

FOREIGN PATENT DOCUMENTS

| | | |
|---|---|---|
| EP | 0 468 439 A2 | 1/1992 |
| EP | 0468 440 A2 | 1/1992 |
| JP | 5-114487 | 5/1993 |
| JP | 6-74345 | 9/1994 |
| JP | 9-156022 | 6/1997 |
| JP | 9-246010 | 9/1997 |
| JP | 10-125474 | 5/1998 |
| JP | 10-204426 | 8/1998 |
| JP | 2000-26851 | 1/2000 |
| JP | 2002-134303 | 5/2002 |
| WO | WO 00/22683 | 4/2000 |

* cited by examiner

MODIFIED ELECTROCONDUCTIVE POLYMER MATERIAL AND METHOD FOR PREPARATION THEREOF

TECHNICAL FIELD

The present invention relates to a modified electroconductive polymer material having high oxidation/reduction resistance and controlled conductivity, and to a method for producing the modified electroconductive polymer material.

BACKGROUND OF THE INVENTION

While it is said that an electroconductive (electrically conductive) polymer are generally excellent in stability against repetitive oxidation/reduction (doping/dedoping), an electroconductive polymer actually developed to a practical level is only polyaniline, but other electroconductive polymers known as wide as polyaniline, such as polpyrrote and polythiophene, have not been put to practical use as an active electrical element, primarily due to problems about durability.

As for possible applications of an electroconductive polymer material to active elements, there have been generally known applications to a hole injection layer in an organic light-emitting element (Patent Publication 1), to an overcurrent protective element (Patent Publications 2 and 3) and to a light-emitting element (Patent Publications 4 and 5), all of which are intended to apply an electroconductive polymer to electrical or electronic elements by itself.

There has also been known a mixed film of an electroconductive polymer and a metal oxide, which is prepared by suspending fine particles of $TiO_2$ or $SiO_2$ in a pyrrole solution as electrolyte to allow a dopant to be doped homogeneously with mobility, and copolymerizing pyrrole to incorporate the fine particles having a particle diameter of 10 to 1000 nm into the obtained polymerized film (Patent Publication 6).

Patent Publication 1: Japanese Patent Laid-Open Publication No. 05-114487

Patent Publication 2: Japanese Patent Laid-Open Publication No. 09-246010

Patent Publication 3: Japanese Patent Laid-Open Publication No. 2002-134303

Patent Publication 4: Japanese Patent Laid-Open Publication No. 10-204426

Patent Publication 5: Japanese Patent Laid-Open Publication No. 2000-026851

Patent Publication 6: Japanese Patent Publication No. 06-074345

BRIEF SUMMARY OF INVENTION

During the course of an oxidizing/reducing (doping/dedoping) process, a large voltage may be applied to an eletroconductive polymer, particularly in a plus direction, to induce a crosslinking reaction between polymer chains. When a film comprises relatively long polymer chains, electrons or holes traveling in the film can move along the chains almost without deviating from the right path to cut through the film in a short time of period. Thus, the film exhibits high conductivity.

However, if the polymer chains are crosslinked therebetween to form sideways, electrons or holes will travel in various directions to cause increase in electrical conduction time. Moreover, such a sideway acts as a pitfall (trap) for electrons or holes in terms of energy, and thereby the lifetime of the trapped electron/hole will run out thereat. This causes lowered conductivity of the film, which leads to aged deterioration (in extreme cases, the polymer will be changed to an electrically insulating material, or the functions as an electroconductive polymer will be lost at this moment).

In addition to this problem, the electroconductive polymer has involved another problem. Specifically, while electrons/holes can freely travel in the range of one of the chains, they have to jump to another chain because the end of one chain is not connected to the end of another chain. This is also regarded as one of the factors causing decrease in electrical conductivity of an electroconductive polymer.

While the technique disclosed in the above Patent Publication 6 is intended to form a mixed film of an electroconductive polymer and a metal oxide, the incorporation of the metal oxide relies on eventuality, and it is impossible to incorporate the metal oxide homogeneously in a controlled amount. Moreover, while the metal oxide to be incorporated is in the form of fine particles, the particles have an average particle diameter of about 100 nm, and thereby the thickness of the electroconductive polymer film has to be increased up to 10 μm or more to allow the particles to be incorporated in a sufficient amount.

The inventors found that an electroconductive polymer material can have enhanced durability against oxidation/reduction, and controlled conductivity by bringing a metal susceptible to oxidation into contact with an electroconductive polymer having a cation radical and a dication (polaron and bipolaron, when expressed by physical terms), and keeping them under the presence of absorbed water.

Specifically, (1) the present invention provides a modified electroconductive polymer material comprising a metal filled in a space between the chains of an electroconductive polymer. The metal is oxidized through a chemical reaction between three substances consisting of the metal, a cation radical/dication, and absorbed water. The metal has a work function less than that of an electroconductive polymer.

(2) In the modified electroconductive polymer material set forth in the above (1), the metal may be one selected from the group consisting of aluminum, titanium, indium, cadmium, manganese, iron, copper, silver, tin, antimony, lead, sodium and calcium.

(3) The present invention also provides a method for producing the modified electroconductive polymer material set forth in the above (1), comprising the steps of; allowing an electroconductive polymer and a metal having a work function less than that of the electroconductive polymer to be brought into contact with one another; and keeping the contact between the metal and the electroconductive polymer, under the presence of absorbed water, so as to create the state of coexistence between three substances consisting of the metal, a cation radical/dication and the absorbed water.

(4) In the method set forth in the above (3), the step of allowing the electroconductive polymer and the metal to be brought into contact with one another includes: forming on a substrate a film made of an electroconductive polymer; and vapor-depositing on a surface of the film a metal having a work function less than that of the electroconductive polymer.

In the electroconductive polymer material of the present invention, a space between polymer chains is filled with an oxidized metal or metal oxide, such as aluminum oxide or indium oxide, so as to prevent the occurrence of a crosslinking reaction due to repetition of oxidation/reduction, and the aged deterioration in the electroconductive polymer material.

During the process of formation of the metal oxide, a water molecule is hydrated in the metal oxide to inevitably form a metal hydroxide in part. That is, a part of the metal oxide exists as a metal hydroxide.

For example, when a space between the chains of the electroconductive polymer is filled with a aluminum oxide having an insulation performance, the aluminum oxide can prevent the occurrence of a crosslinking reaction, but will hinder electrons/holes from jumping from the end of one chain to the end of another chain. That is, while aged deterioration can be prevented, an electrical conductivity of the entire film is lowered. In contrast, if the space is filled with an indium oxide having a high conductivity, the indium oxide can provide enhanced conductivity while preventing aged deterioration.

According to the production method of the present invention, the amount of the metal oxide to be incorporated in the electroconductive polymer is determined by the amount of vapor-deposited metal, and thereby can be controlled exactly or properly. In addition, the metal oxide to be incorporated has a small dimensional size of about several nm. Thus, even if an electroconductive polymer film having a thickness of about 1 μm or sub-micrometer is used, the compounding (hybridization) can be adequately achieved.

The electroconductive polymer material of the present invention having stable electrical properties (enhanced durability) can exhibit excellent characteristics in applications to various elements, in which inorganic semiconductors and metals have been monopolistically used, such as a capacitor, an electrode material for secondary batteries, an organic circuit pattern (organic thin-film transistor etc.), an antistatic sheet or an organic thin-film light-emitting element.

(Function)

Generally, when a film-forming material made of an electroconductive polymer and dissolved in a solution is oxidized on an electrode substrate, it is polymerized in the form of a film. In concurrence with this polymerization, a reaction causing oxidation of the polymer film itself is induced to create a cation radical and a dication having a positive charge, in the polymer film.

In the above process, a negative ion (referred to as "dopant"), such as $ClO_4^-$, $BF_4^-$, $PF_6^-$ or para-toluene sulfonate ion, may be added into the solution. In this case, the negative ion is incorporated into the polymer film, and the cation radical and dication are electrically neutralized by the incorporated negative ion.

FIG. 1 schematically shows a chemical reaction between three substances consisting of a metal, a cation radical/dication, and absorbed water. As shown in FIG. 1, a metal 1, such as aluminum or indium, which is a metal having a work function less than that of an electroconductive polymer 3 constituting a film, is attached on the film through a vapor deposition process or the like so as to allow the metal 1 to be brought into contact with the film 3 (see the upper portion in FIG. 1).

In order to more efficiently induce the chemical reaction between three substances consisting of the metal, the cation radical/dication, and the absorbed water, it is desirable to allow the absorbed water to be in contact with the metal and the surface of the film-shaped electroconductive polymer 3 in a larger area. Thus, a vapor deposition process for forming an inhomogeneous pattern, such as island-shaped pattern, may be used as one of preferable techniques. Further, the film-shaped electroconductive polymer 3 may have a structural defect, such as micro-void, micro-scratch or pinhole. In this case, a micro-void, micro-scratch or pinhole 4 can be formed in the vapor-deposited metal 1 as shown in FIG. 1 to increase the contact area.

Then, as enlargedly illustrated in the lower portion of FIG. 1, the electroconductive polymer 3 having the metal 1 attached thereon is kept in the state of coexistence with the absorbed water 2. Thus, the absorbed water 2 penetrates into the electroconductive polymer 3 through the micro-void, micro-scratch or pinhole 4, so that a chemical reaction is induced between three substances consisting of the metal 1, the cation radical/dication 9 and the absorbed water 2, and the metal 1 susceptible to oxidation is oxidized (partially formed as hydroxide) while entering into the electroconductive polymer 3.

Further, through a reducing reaction induced in the electroconductive polymer 3, the cation radical and dication 9 in the polymer are vanished, and the dopant 8 is dedoped. The formed metal oxide/hydroxide 7 enters into the electroconductive polymer 3, and diffusingly moves therein to reside in a nano-space between polymer chains 10.

The above result comes from the phenomenon that a galvanic battery is formed between three substances consisting of the metal, the cation radical/dication and the absorbed water, to induce the electron transfer from the oxidation-susceptible metal having a less work function to the polypyrrole film having a greater work function. As the result of the electron transfer, the oxidation-susceptible metal is oxidized through a galvanic corrosion reaction under the presence of the absorbed water, and changed to an oxide of the metal ($Al_2O_3$/hydroxide ($Al_2O_3.xH_2O$ when the metal is aluminum).

FIG. 2 is a schematic diagram showing an electroconductive polymer material modified through such a galvanic corrosion reaction. As shown in FIG. 2, an electroconductive polymer is obtained in which the aluminum oxide/hydroxide 7 formed through the chemical reaction between three substances consisting of the metal, the cation radical/dication, and the absorbed water is included in the space between the polymer chains 10. While a part of the dopant 8 and/or an unreacted part of the cation radical/dication 9 will remain after the dedoping if the amount of vapor-deposited metal is insufficient, the level of the remaining amount can be adjusted by the amount of metal to be vapor-deposited.

BRIEF DESCRIPTION OF DRAWINGS

FIG. 5(*b*) is a cyclic voltammogram of the absorbed aluminum-containing polypyrrole film in Inventive Example 1.

DETAILED DESCRIPTION OF THE INVENTION

Figure 1:
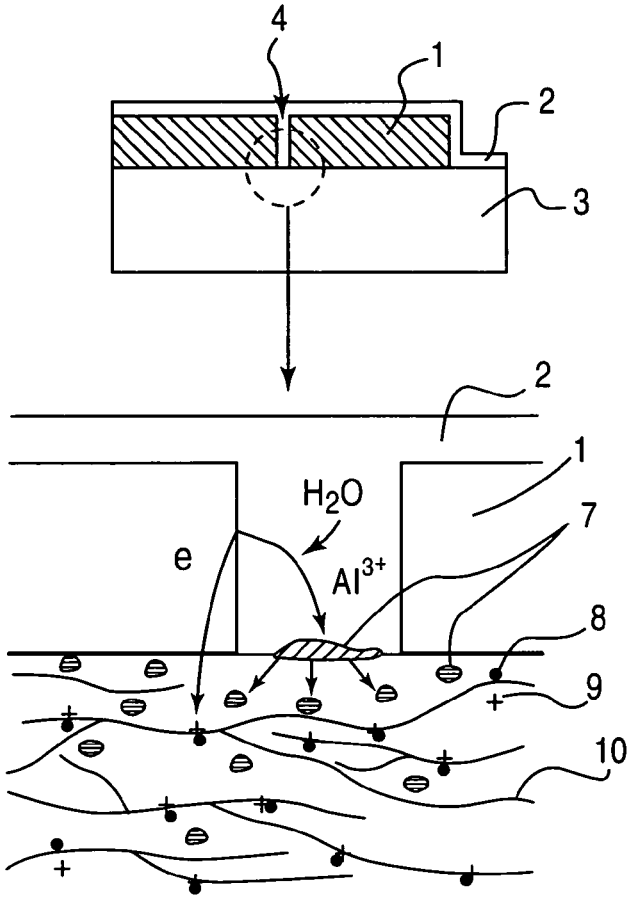
FIG. 1 is a schematic diagram showing a chemical reaction between three substances consisting of a metal, a cation radical/dication, and absorbed water, in a production method for a modified electroconductive polymer material of the present invention.
Figure 2:
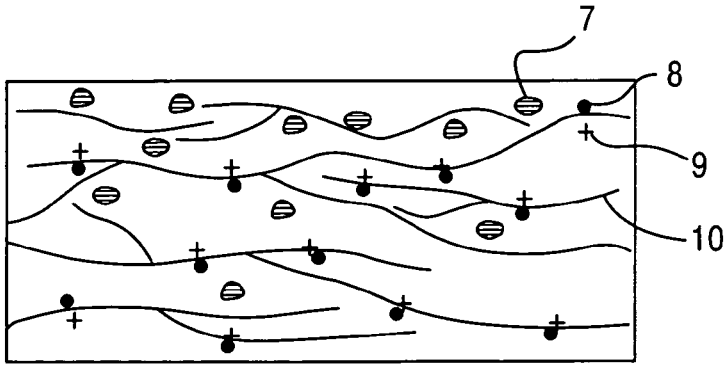
FIG. 2 is a schematic diagram showing the structure of a modified electroconductive polymer material of the present invention.

A polymer to be used in the present invention is not limited to a specific type, but may be any suitable type, for example, a chain electroconductive polymer, such as polypyrrole, polyindole, polycarbazole, polythiophene derivatives (including original polythiophene: the same is applied to the folliowing derivatives), polyaniline derivatives, polyacetylene derivative, poly-furan derivatives, poly-para-phenylene vinylene derivatives, polyazulene derivatives, poly-para-phenylene derivatives poly-para-phenylene sulphide derivative, poly-isothianaphthene derivatives or poly thiazyl; or a polyacene-based eletroconductive polymer.

A process for forming a film made of the electroconductive polymer is not limited to a specific process, but may be any suitable conventional process, typically, including an electrolytic polymerization process, a chemical polymerization process and a solution spreading process. A vapor deposition process may also be used if associated materials have a heat-resistance.

In order to create the state of coexistence between three substances consisting of a metal, a cation radical/dication, and absorbed water, a metal is firstly brought into contact with an electroconductive polymer. This may be achieved by one process comprising forming on a substrate a film made of an electroconductive polymer, and vapor-depositing on a surface of the film a metal having a work function less than that of the electroconductive polymer.

The metal having a work function less than that of the electroconductive polymer, for example, aluminum, titanium, indium, cadmium, manganese, iron, copper, silver, tin, antimony, lead, sodium and calcium, is vapor-deposited on a surface of the electroconductive polymer film, and the contact therebetween is kept under the presence of absorbed water. In this state, the vapor-deposited metal is oxidized (partially formed as a hydroxide), and simultaneously absorbed in the polymer film. In particular, an indium oxide exhibiting a high conductivity equivalent to that of metal, as is well known, may be used to bridge formation to provide significantly enhanced conductivity in the electroconductive polymer. In the above process, even if a metal having a relatively large work function, i.e. gold, platinum, nickel, iridium or palladium, is vapor-deposited, the above phenomenon of metal absorption to the inside of the electroconductive polymer will never occur.

Except under vacuum, a substance is generally covered by absorbed water. Thus, the state of coexistence with the absorbed water can be maintained only by keeping the contact between the electroconductive polymer and the metal having a work function less than that of the electroconductive polymer, in an ordinary or normal atmosphere (e.g. temperature: 20° C., relative humidity: 50%), or by allowing the metal and the electroconductive polymer to get wet even if only slightly.

If a vapor deposition process is used, a vapor-deposited metal can be simply placed in a normal atmosphere together with an electroconductive polymer to obtain a modified electroconductive polymer material having previously-unachievable excellent characteristics, efficiently without any cost problem. The process for depositing the metal is not limited to the vapor deposition process, but may be any other suitable deposition process, such as a sputtering process, a plating process, an electrodeposition process or an electron beam process.

EXAMPLE

Inventive Example 1

Through an electrolytic polymerization process using a dichloromethane solution containing pyrrole (2 mM) and tetraethylammonium perchlorate (65 mM) dissolved therein, as electrolyte, and a glass substrate spin-coated with an indium tin oxide (hereinafter referred to as "ITO") film, as an operation electrode, a polypyrrole film was formed on the ITO film.

The conditions of the electrolytic polymerization were set as follows: a polymerization potential of 1.1 V (expressed by a potential relative to a saturated calomel reference electrode), a polymerization temperature of 0° C. and a supply electrical quantity of 0.7 C/cm$^2$. While the electrolytic polymerization was performed under a nitrogen atmosphere, the nitrogen atmosphere is not essential to the polymerization atmosphere.

Through this process, a perchlorate ion ($ClO_4^-$)-doped polypyrrole film having a thickness of about 400 nm was formed on the ITO film.

Then, through a vacuum vapor deposition process, an aluminum metal film having a thickness of about 20 nm was vapor-deposited on a surface of the polypyrrole film. The vapor deposition was performed in a vacuum degree of $10^{-3}$ Pa at a room temperature (22° C.).

The glass substrate having the aluminum film vapor-deposited on a surface of the polypyrrole film was taken out of a vapor deposition apparatus. Then, an aged deterioration was observed under the condition that the glass substrate was left in an air-conditioned room set to have a temperature of 20° C. and a humidity of 50%.

After 5 minutes from the vapor deposition, a part of aluminum in the vapor-deposited aluminum film already started disappearing. Then, the aluminum gradually disappeared, and completely vanished after 12 hours.

Figure 3:
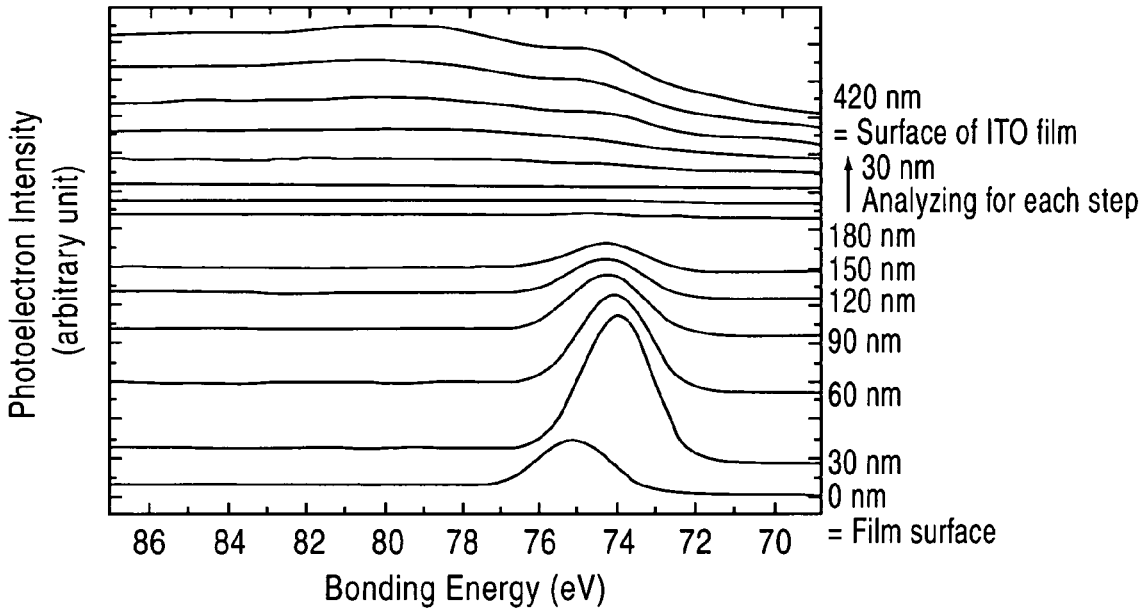
FIG. 3 is a graph showing a test result obtained by stepwise cutting a surface of an absorbed aluminum-containing polypyrrole film in Inventive Example 1, and subjecting the film to an elemental analysis based on an X-ray photoelectron spectroscopy analysis after each cutting.

FIG. 3 shows a test result obtained by stepwise cutting a surface of the absorbed aluminum-containing polypyrrole film in Inventive Example 1, and subjecting the film to an elemental analysis based on an X-ray photoelectron spectroscopy analysis (generally abbreviated as "XPS") as after each cutting.

The scale of the right or vertical axis represents a depth from the film surface, wherein the point 0 nm indicates the film surface, and the point 420 nm indicates the boundary between the ITO film and the glass substrate. The horizontal axis represents a bonding energy of an element of interest, specifically, a bonding energy of a 2p electron of an aluminum atom in this graph.

A signal is observed at a bonding energy of 74 to 75 eV. This is a signal of aluminum constituting an aluminum oxide ($Al_2O_3$) or an aluminum hydroxide ($Al_2O_3.xH_2O$). While aluminum in the metallic state must generate a signal at 71.4 eV, no signal appears at the value. This proves that the vapor-deposited aluminum entered into the polypyrrole film, and reached a depth of 150 to 180 nm.

Figure 4:
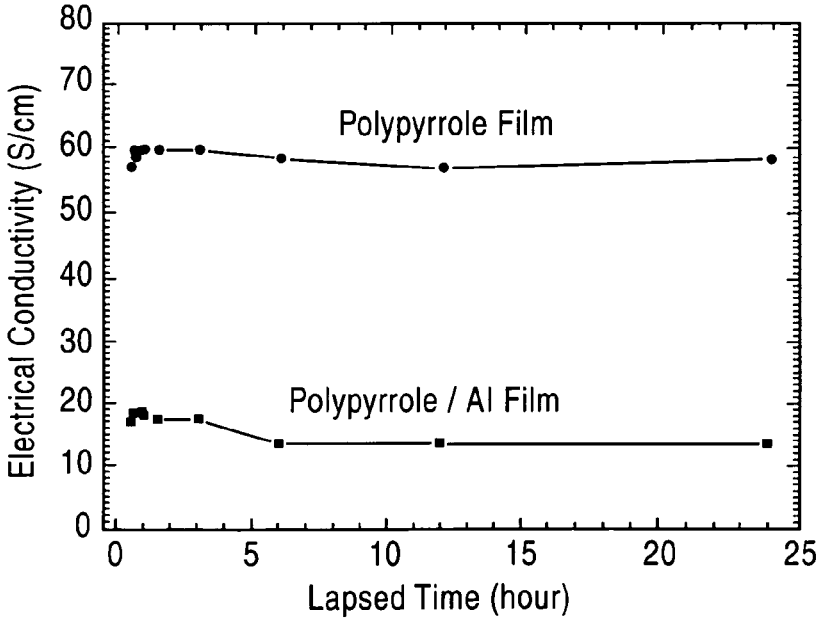
FIG. 4 is a graph showing an aged deterioration in electrical conductivity of each of the absorbed aluminum-containing polypyrrole film in Inventive Example 1 and a polypyrrole film having no vapor-deposited metal.

FIG. 4 shows a measurement result of an aged deterioration in electrical conductivity of each of the polypyrrole film having the vapor-deposited aluminum and a polypyrrole film having no vapor-deposited metal. In FIG. 4, the zero point of the lapsed time for the polypyrrole film having no vapor-deposited metal was defined by a time point immediately after the electrolytic polymerization, and the zero point for the sample having the vapor-deposited aluminum film was defined by a time point immediately after the vapor deposition. The measurement was initiated after 30 minutes from the zero point of the lapsed time.

In the sample having the vapor-deposited aluminum, an aluminum oxide gets into a space between the electroconductive polymer chains, and thereby the sample has an electrical conductivity reduced to about ¼ to ⅕ of that of the film having no vapor-deposited aluminum. However, it should be noted that the value of the lowered conductivity is still a numeric representing a high-conductivity region, and the sample still remains in an electroconductive polymer.

Figure 5A:
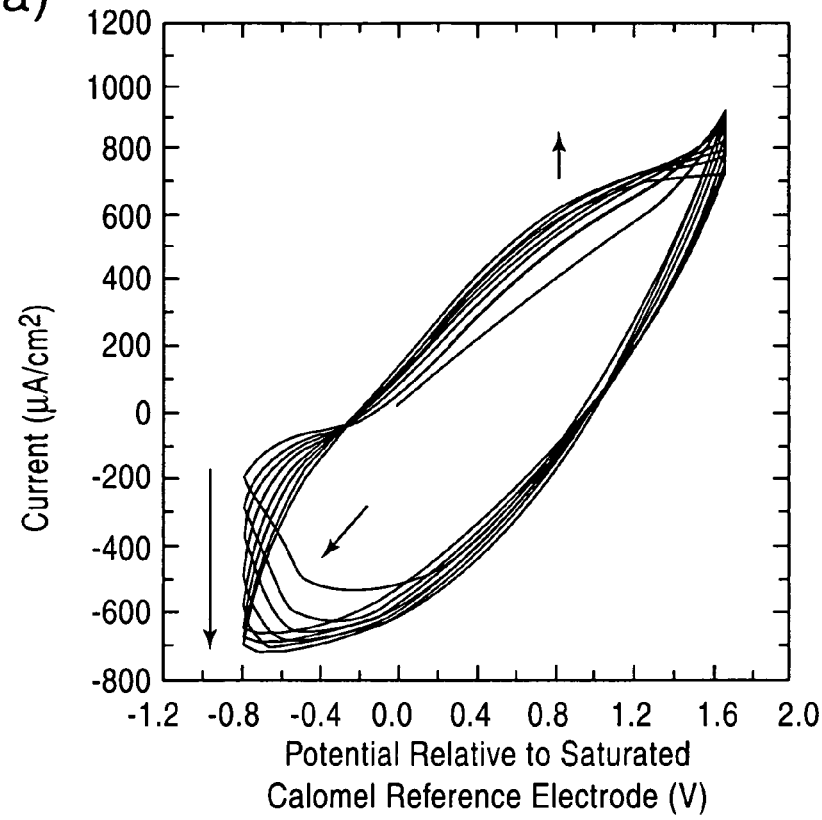
FIG. 5(*a*) is a cyclic voltammogram of a polypyrrole film having no vapor-deposited metal.
Figure 5B:
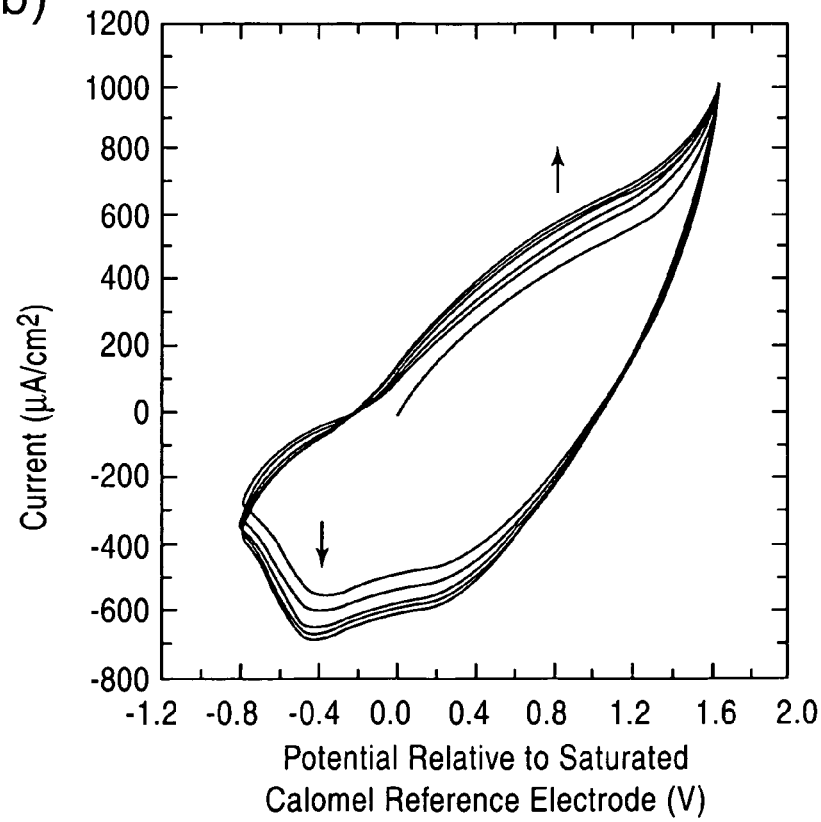

FIG. 5(*a*) is a cyclic voltammogram of a polypyrrole film having no vapor-deposited metal.

FIG. 5(*b*) is a cyclic voltammogram of the polypyrrole film having the vapor-deposited aluminum film. When a positive potential is applied to the polypyrrole film, a current will flow in a plus direction. This corresponds to the state when the film is oxidized to create a radical cation and a dication, and $ClO_4^-$ enters from the electrolyte into the film to electrically neutralize the cation radical/dication.

As seen in FIG. 5(*a*), the waveform gradually squashes along with repetition of potential sweep, and changes to have an oval shape. This behavior is observed when the film has a lowered electrical conductivity, and an increased electrical resistance. That is, FIG. 5(*a*) shows that the film is gradually deteriorated. In contrast, as seen in FIG. 5(*b*), the waveforms overlap from the time around the 4th sweep, and the film has stable oxidation/reduction. This proves that durability of the polypyrrole against oxidation/reduction is significantly improved.

Inventive Example 2

Except that a metal to be vapor-deposited was changed from aluminum to indium, a sample having an indium film vapor-deposited on a surface of a polypyrrole film was prepared under the same conditions as those in Inventive Example 1.

The phenomenon of disappearance of the indium was observed in the same manner as that in Inventive Example 1.

On the analogy of the aluminum case, it is proven that the indium reacted with cations (cation radical/dication) and absorbed water in the polypyrrole, and incorporated in the film in the form of a modified transparent substance consisting of indium oxide ($In_2O_3$)/indium hydroxide ($In_2O_3/xH_2O$) (slightly yellow-tinged substance)

Figure 6:
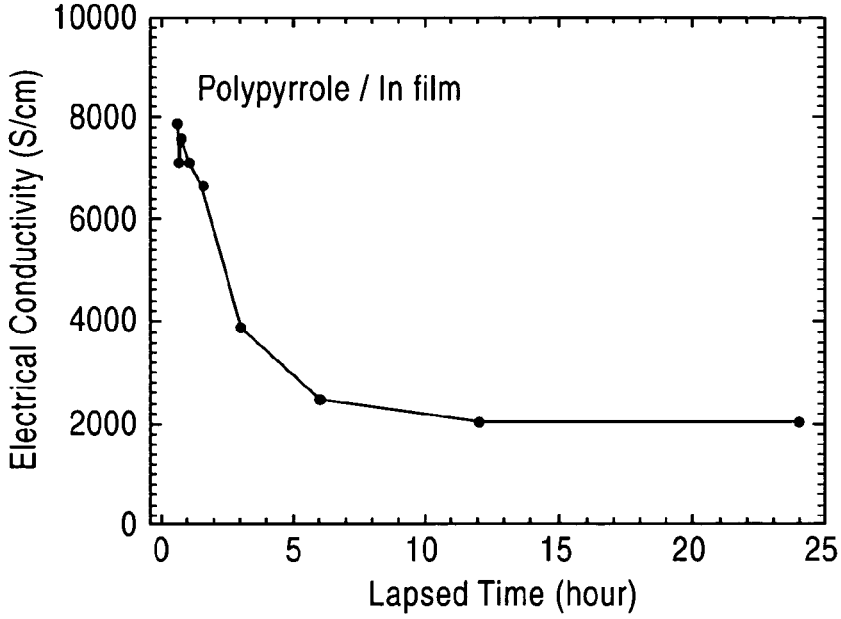
FIG. 6 is a graph showing an aged deterioration in electrical conductivity of an absorbed indium-containing polypyrrole film in Inventive Example 2.

FIG. 6 shows an aged deterioration in electrical conductivity of the polypyrrole film having the indium oxide/indium hydroxide absorbed therein, through a 4-terminal measuring method, wherein the zero point of the lapsed time is defined by a time point just after vapor-deposition of the indium. As seen in FIG. 6, while the conductivity of the sample is lowered until a lapsed time of 5 hours, a stabilized conductivity has a high value of 2000 S/cm, which is 34 times of that in the polypyrrole film before the vapor deposition. This can be understood as meaning that the indium oxide resides in the polypyrrole film, and contributes to increase in conductivity, as described above.

Figure 7:
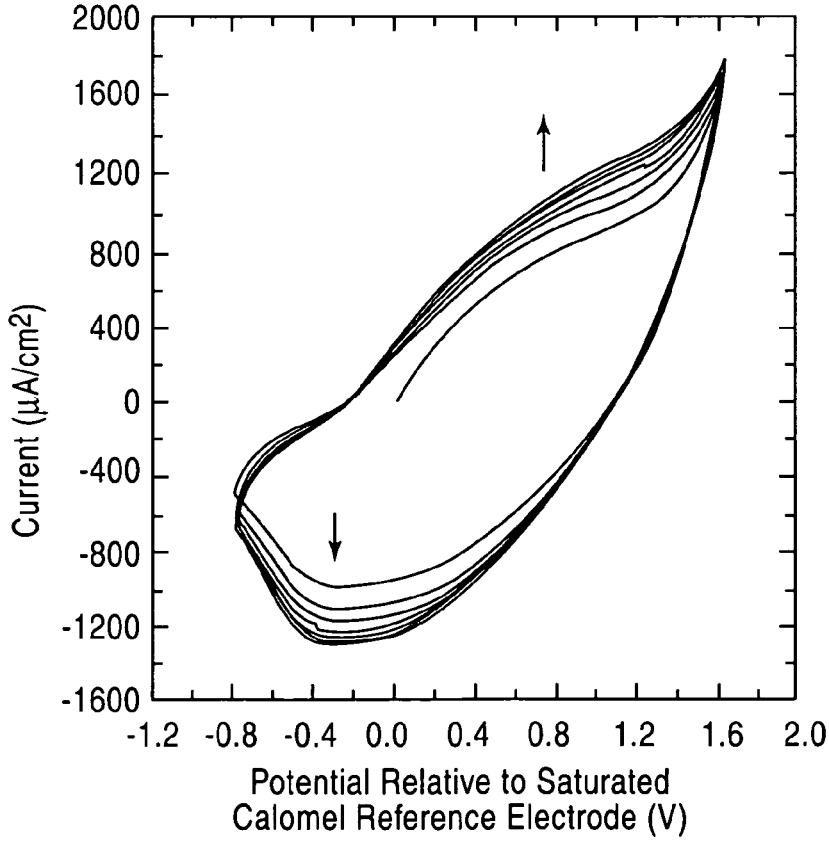
FIG. 7 is a cyclic voltammogram of the absorbed indium-containing polypyrrole film in Inventive Example 2.

FIG. 7 shows a cyclic voltammogram of the polypyrrole film having the indium oxide/indium hydroxide absorbed therein. As seen in FIG. 7, the incorporation of an indium oxide in a polypyrrole film also has the effect of providing enhanced durability of the film.

Comparative Example 1

Except that poly (methyl methacrylate), which is a polymer having an insulating performance, was used in place of pyrrole, an aluminum film was vapor-deposited on a surface of a poly (methyl methacrylate) film under the same conditions as those in Inventive Example 1, wherein tetraethylammonium perchlorate was dispersed in the poly (methyl methacrylate) film. This state means that vapor-deposited aluminum and absorbed water coexist, but no cation radical/dication exists. In this example, no disappearance of the aluminum film occurred. This verifies that the phenomenon of disappearance of the aluminum is based on the presence of a cation radical or dication, and requires inducing the flow of electrons from the aluminum to the polymer film

Comparative Example 2

Except that a metal to be vapor-deposited was changed from aluminum to gold, a sample having a gold film vapor-deposited on a surface of a polypyrrole film was prepared under the same conditions as those in Inventive Example 1.

In the polypyrrole film having a noble metal, such as gold vapor-deposited thereon, no metal was incorporated into the polypyrrole film even after a lapse of a one week from the vapor deposition. When gold is used, no electron flow from the gold to the polymer film is induced because gold has a work function approximately equal to that of polypyrrole. This also demonstrates the importance of the electron flow (current).

Comparative Example 3

The aluminum/polypyrrole sample prepared in Inventive Example 1 was stored under vacuum ($10^{-3}$ Pa) instead of in the air. As a result, no disappearance of the aluminum occurred even after a lapse of 24 hours. This reason is that a sufficient amount of absorbed water could not obtained from the vacuum atmosphere, and thereby the state of coexistence between three substances consisting of the aluminum, the cation radical/dication, and absorbed water could not be created.

INDUSTRIAL APPLICABILITY

According to the present invention, high durability against oxidation/reduction and enhanced control of conductivity, which could not be obtained in electroconductive polymers prepared through conventional techniques, can be achieved. Thus, the present invention can contribute to the practical use of an electroconductive polymer as a material for various electrical and electronic elements.

What is claimed is:

1. A method for producing a modified electroconductive polymer material comprising an electroconductive polymer; and a metal oxide filled in a space between chains of said electroconductive polymer, said metal being oxidized through a galvanic corrosion reaction between three substances consisting of a metal, a cation radical/dication in the electroconductive polymer, and absorbed water, said method comprising the steps of:

allowing an electroconductive polymer and a metal having a work function less than that of said electroconductive polymer to be brought into contact with one another;

keeping the contact between said metal and said electroconductive polymer, under the presence of absorbed water, so as to create the state of coexistence and forming a galvanic battery between three substances consisting of said metal, a cation radical/dication in the electroconductive polymer and said absorbed water; and entering a formed metal oxide/hydroxide into the electroconductive polymer, and diffusingly moving therein to reside in nano-space between chains of said electroconductive polymer, wherein said step of allowing said electroconductive polymer and said metal to be brought into contact with one another includes:

forming on a substrate a film made of an electroconductive polymer;

vapor-depositing on a surface of said film a metal having a work function less than that of said electroconductive polymer; and penetrating the absorbed water into the electroconductive polymer through the microvoid, micro-scratch or pinhole.

2. A method for producing a modified electroconductive polymer material comprising an electroconductive polymer; and a metal oxide filled in a space between chains of said electroconductive polymer, said metal being oxidized through a galvanic corrosion reaction between three substances consisting of a metal, a cation radical/dication in the electroconductive polymer, and absorbed water, said method comprising the steps of:

allowing an electroconductive polymer and a metal having a work function less than that of said electroconductive polymer to be brought into contact with one another;

keeping the contact between said metal and said electroconductive polymer, under the presence of absorbed water, so as to create the state of coexistence and forming a galvanic battery between three substances consisting of said metal, a cation radical/dication in the electroconductive polymer and said absorbed water;

entering a formed metal oxide/hydroxide into the electroconductive polymer, and diffusingly moving therein to reside in nano-space between chains of said electroconductive polymer; and further comprising a reducing reaction induced by adding a negative ion.

3. The method as defined in claim 2, wherein said negative ion is at least one selected from the group consisting of $ClO_4^-$, $BF_4^-$, $PF_6^-$ and para-toluene sulfonate ion.

4. A method for producing a modified electroconductive polymer material comprising an electroconductive polymer; and a metal oxide filled in a space between chains of said electroconductive polymer, said metal being oxidized through a galvanic corrosion reaction between three substances consisting of a metal, a cation radical/dication in the electroconductive polymer, and absorbed water, said method comvrising the steps of:

allowing an electroconductive polymer and a metal having a work function less than that of said electroconductive polymer to be brought into contact with one another;

keeping the contact between said metal and said electroconductive polymer, under the presence of absorbed water, so as to create the state of coexistence and forming a galvanic battery between three substances consisting of said metal, a cation radical/dication in the electroconductive polymer and said absorbed water; and entering a formed metal oxide/hydroxide into the electroconductive polymer, and diffusingly moving therein to reside in nano-space between chains of said electroconductive polymer;

wherein said metal is contacted with said electroconductive polymer in an inhomogeneous pattern.

5. A method for producing a modified electroconduetive polymer material comprising an electroconductive polymer; and a metal oxide filled in a space between chains of said electroconductive polymer, said metal being oxidized through a galvanic corrosion reaction between three substances consisting of a metal, a cation radical/dication in the electroconductive polymer, and absorbed water, said method comprising the steps of:

allowing an electroconductive polymer and a metal having a work function less than that of said electroconductive polymer to be brought into contact with one another;

keeping the contact between said metal and said electroconductive polymer, under the presence of absorbed water, so as to create the state of coexistence and forming a galvanic battery between three substances consisting of said metal, a cation radical/dication in the electroconductive polymer and said absorbed water; and entering a formed metal oxide/hydroxide into the electroconductive polymer, and diffusingly moving therein to reside in nano-space between chains of said electroconductive polymer;

wherein said metal contacted with said electroconductive polymer has a structural defect.

6. The method as defined in claim 5, wherein said structural defect is at least one selected from the group consisting of a micro-void, micro-scratch and a pinhole.

7. A method for producing a modified electroconductive polymer material comprising an electroconductive polymer; and a metal oxide filled in a space between chains of said electroconductive polymer, said metal being oxidized through a galvanic corrosion reaction between three substances consisting of a metal, a cation radical/dication in the electroconductive polymer, and absorbed water, said method comprising the steps of:

allowing an electroconductive polymer and a metal having a work function less than that of said electroconductive polymer to be brought into contact with one another;

keeping the contact between said metal and said electroconductive polymer, under the presence of absorbed water, so as to create the state of coexistence and forming a galvanic battery between three substances consisting of said metal, a cation radical/dication in the electroconductive polymer and said absorbed water; and entering a formed metal oxide/hydroxide into the electroconductive polymer, and diffusingly moving therein to reside in nano-space between chains of said electroconductive polymer;

wherein said metal is brought into contact with said electroconductive polymer by a deposition process selected from the group consisting of vapor deposition, a sputtering process, a plating process, an electrodeposition process and an electron beam process.

* * * * *